US010247192B2

(12) United States Patent
Brillet et al.

(10) Patent No.: US 10,247,192 B2
(45) Date of Patent: Apr. 2, 2019

(54) SEALING ASSEMBLY FOR TURBOMACHINE

(71) Applicant: Turbomeca, Bordes (FR)

(72) Inventors: Christophe Michel Georges Marcel Brillet, Gan (FR); Pierre Chabanne, Idron (FR); Julien Girardot, Angais (FR); Lionel Scuiller, Billere (FR)

(73) Assignee: SAFRAN HELICOPTER ENGINES, Bordes (FR)

( * ) Notice: Subject to any disclaimer, the term of this patent is extended or adjusted under 35 U.S.C. 154(b) by 622 days.

(21) Appl. No.: 14/649,835

(22) PCT Filed: Dec. 18, 2013

(86) PCT No.: PCT/FR2013/053174
§ 371 (c)(1),
(2) Date: Jun. 4, 2015

(87) PCT Pub. No.: WO2014/096708
PCT Pub. Date: Jun. 26, 2014

(65) Prior Publication Data

US 2015/0330402 A1 Nov. 19, 2015

(30) Foreign Application Priority Data

Dec. 21, 2012 (FR) ..... 12 62620

(51) Int. Cl.
*F04D 29/16* (2006.01)
*F04D 29/063* (2006.01)
(Continued)

(52) U.S. Cl.
CPC ..... *F04D 29/063* (2013.01); *F01D 11/04* (2013.01); *F04D 29/083* (2013.01);
(Continued)

(58) Field of Classification Search
CPC .... F04D 29/063; F04D 29/162; F04D 29/083; F04D 29/102; F04D 29/124; F01D 11/04;
(Continued)

(56) References Cited

U.S. PATENT DOCUMENTS 2,660,367 A * 11/1953 Ehlinger ..... F04D 29/063 277/348
3,966,351 A * 6/1976 Sproule ..... F01D 11/04 415/110
(Continued)

FOREIGN PATENT DOCUMENTS

EP 0 831 204 A1 3/1998
EP 1 577 495 A1 9/2005
(Continued)

OTHER PUBLICATIONS

EPO, Translation of WO 2011051592 A1, retrieved Mar. 26, 2018.*
(Continued)

*Primary Examiner* — Carlos A Rivera
*Assistant Examiner* — Jesse Prager
(74) *Attorney, Agent, or Firm* — Christensen O'Connor Johnson Kindness PLLC

(57) ABSTRACT

The invention relates to a turbine engine comprising an air compression stage comprising at least one movable compressor wheel, an air inlet duct coupled to said air compression stage, a first sealing device, which is arranged between a front portion of the movable compressor wheel and the air inlet duct and comprising at least one seal, a channel for conveying the air compressed by the movable wheel and a second sealing device, which is arranged between a rear portion of the movable compressor wheel and the conveying channel and is configured to receive an airflow coming from the conveying channel, the turbine engine being remarkable in that the second sealing device is configured to allow some
(Continued)

of the air passing therethrough to be bled and in that the bleed air is conveyed to the seal of the first sealing device so as to keep it under pressure.

10 Claims, 4 Drawing Sheets

(51) Int. Cl.
*F04D 29/12* (2006.01)
*F04D 29/08* (2006.01)
*F04D 29/10* (2006.01)
*F01D 11/04* (2006.01)

(52) U.S. Cl.
CPC ..... *F04D 29/102* (2013.01); *F04D 29/124* (2013.01); *F04D 29/162* (2013.01); *F05D 2220/3217* (2013.01)

(58) Field of Classification Search
CPC ..... F01D 11/06; F05D 2220/3217; F05D 2260/606
USPC ..... 277/415, 411–412, 418
See application file for complete search history.

(56) References Cited

U.S. PATENT DOCUMENTS

| | | | | |
|---|---|---|---|---|
| 5,249,934 | A * | 10/1993 | Merritt | F04D 29/5853 417/406 |
| 7,363,762 | B2 * | 4/2008 | Montgomery | F01D 11/02 29/464 |
| 2005/0196088 | A1 | 9/2005 | Charier | |
| 2009/0297341 | A1 * | 12/2009 | Turnquist | F01D 11/04 415/173.3 |
| 2010/0028148 | A1 * | 2/2010 | Nakaniwa | F04D 17/12 415/230 |
| 2012/0201658 | A1 | 8/2012 | Le Brusq | |
| 2013/0164119 | A1 | 6/2013 | Nakaniwa | |

FOREIGN PATENT DOCUMENTS

| | | | | |
|---|---|---|---|---|
| FR | 2 952 138 | A1 | 5/2011 | |
| JP | S63 198 | U | 1/1988 | |
| WO | WO 2011051592 | A1 * | 5/2011 | F01D 5/025 |
| WO | 2012/033192 | A1 | 3/2012 | |

OTHER PUBLICATIONS

Written Opinion of the International Searching Authority dated Mar. 17, 2014, issued in corresponding International Application No. PCT/FR2013/053174, filed Dec. 18, 2013, 9 pages.
International Preliminary Report on Patentability dated Jun. 23, 2015, issued in corresponding International Application No. PCT/FR2013/053174, filed Dec. 18, 2013, 1 page.
International Search Report dated Mar. 17, 2014, issued in corresponding International Application No. PCT/FR2013/053174, filed Dec. 18, 2013, 2 pages.

* cited by examiner

SEALING ASSEMBLY FOR TURBOMACHINE

FIELD OF THE DISCLOSURE

Embodiments of the disclosure relate to the field of turbine engines. Although they have been designed for an aircraft turboshaft engine and are described hereinafter in relation to such a turboshaft engine, embodiments of the disclosure more generally relate to a turbine engine, in particular for an aircraft.

BACKGROUND

In a known manner, a turboshaft engine comprises an air inlet duct, a first air compression stage comprising a movable compressor wheel onto which the duct opens, a channel for conveying air compressed by the first compression stage to a second compression stage, a chamber for combusting a mixture of fuel and the air compressed by the compression stages and one or more stages for expanding the combustion gases.

In such a turboshaft engine, it is known to arrange seals between certain movable parts (rotor) and certain stationary parts (stator) of the turboshaft engine, in particular, on one hand, between the air inlet duct and the front of the first movable compressor wheel and, on the other hand, between the channel for conveying compressed air and the rear of the first movable compressor wheel. The terms "front" and "rear" are understood in relation to the direction of the axis of the turboshaft engine in which the flow of air flows overall in the turboshaft engine during operation.

It is thus known to arrange a sealing device comprising two seals between the front portion of the first movable compressor wheel and the air inlet duct. Said sealing device communicates, via the front seal, with a guide bearing of the rotor shaft of the turbine engine, which bearing is mounted in front of the device and comprises lubricating oil.

In order to keep the oil in the guide bearing in order to prevent it from leaking into the air inlet duct and causing the turboshaft engine to malfunction, air from the conveying channel, which is located downstream of the first compression stage, is conveyed to the sealing device so as to keep the two seals of the device under pressure. The terms "upstream" and "downstream" are understood in relation to the direction of the airflow.

More specifically, some of the airflow which is circulating in the conveying channel is diverted towards a second sealing device, which comprises a seal of which the function is to limit the flow rate of centrifugal air flowing along the rear face of the first movable compressor wheel. In fact, since the expanded airflow which flows along the rear face of the movable wheel then mixes with the airflow compressed by said wheel, too high a flow rate of air behind the wheel would reduce the efficiency of the compression.

Some of the airflow passing through the seal of the second device therefore flows along the rear face of the first movable wheel, whereas the remaining airflow flows along the rotor shaft to a cavity extending between the two seals of the first sealing device so as to keep said seals under pressure. The air in the cavity which keeps the two seals under pressure then flows both towards the guide bearing through the front seal of the first sealing device and towards the air inlet duct through the rear seal of the first sealing device. The airflow rate is therefore particularly reduced when the air is passing through the seal of the second sealing device, but generally allows the seals of the first sealing device to be kept under sufficient pressure so that the oil of the guide bearing is prevented from leaking into the air inlet duct of the turboshaft engine.

However, a problem arises when a reduction in pressure occurs in the air inlet duct upstream of the first movable compressor wheel which is caused, for example, by the presence of a grille, referred to as a pre-rotation grille, for guiding the airflow at the inlet of the movable wheel or by the presence of ice obstructing the duct during operation of the turboshaft engine in icy conditions.

Such a reduction in pressure in the air inlet duct leads to a reduction in pressure in the cavity which extends between the seals of the first sealing device, and this may cause the oil contained in the guide bearing to leak into the air inlet duct and therefore cause the turboshaft engine to malfunction, which is a significant drawback.

SUMMARY

Embodiments of the disclosure aim to improve upon the existing turbine engines, and more particularly to prevent lubricating oil contained in the guide bearing from leaking into the air inlet duct of the turboshaft engine.

Therefore, embodiments of the disclosure relate to a turbine engine comprising:

- an air inlet duct,
- an air compression stage which comprises at least one movable compressor wheel and onto which the air inlet duct opens,
- a first sealing device, which is arranged between a front portion of the movable compressor wheel and the air inlet duct, comprising at least one seal,
- a channel for conveying the air compressed by the movable wheel,
- a second sealing device, which is arranged between a rear portion of the movable compressor wheel and the conveying channel and is configured to receive an airflow coming from the conveying channel,
- said turbine engine being remarkable in that the second sealing device is configured to allow some of the air passing therethrough to be bled, the bleed air being conveyed to the seal of the first sealing device so as to keep it under pressure.

The expression "keep under pressure" means maintaining a pressure which is sufficient to prevent lubricating oil from passing through the first sealing device and from leaking, in particular into the air inlet duct.

Preferably, the turbine engine comprises a guide bearing which is arranged in front of the seal of the first sealing device and comprises lubricating oil, the oil being kept in the guide bearing by pressurised air flowing through the seal from the first device towards the bearing.

The second sealing device is therefore configured such that the flow rate of air which is bled as it passes into said device is sufficiently high so that the air keeps said seal under pressure once said air has been conveyed to the seal of the first sealing device. The turbine engine according to embodiments of the disclosure advantageously allow the seal of the first sealing device to be kept under pressure, even in the event of a drop in pressure in the air inlet duct.

Preferably, the second sealing device is configured so as to supply, on one hand, a first airflow of which the flow rate is sufficient to keep the seal of the first sealing device under pressure and, on the other hand, a second airflow of which the flow rate is sufficiently low to avoid disturbing the flow of the air along the rear face of the movable compressor wheel. Therefore, on one hand, the oil does not leak into the air inlet duct through the seal of the first device and, on the other hand, the efficiency of the compression of the air is not reduced by the air which discharges from the second device at the rear of the movable wheel.

Therefore, according to an embodiment, the second sealing device is configured such that the reduction in the flow rate of the air entering the second sealing device from the channel for conveying compressed air and the flow rate of the air which is bled as it passes into said device remain sufficiently low so that the airflow bled in the second device and conveyed to the seal of the first sealing device keeps said airflow under pressure. Such a calibration may be carried out, for example, by selecting the point in the second sealing device at which the air is bled.

In addition, according to another embodiment, the second sealing device is configured so as to reduce the flow rate of the air passing therethrough in total as much as possible, that is to say the air which is not bled as it passes into the second sealing device and then flows along the rear face of the movable wheel. Such a reduction in the airflow rate makes it possible to significantly reduce or even avoid disturbance to the centrifugal flow of the air along the rear face of the movable compressor wheel and therefore also of the airflow which is reintroduced, at the rear of the first movable wheel, into the airflow which is compressed by the first movable wheel, thereby allowing the efficiency of compression to be improved.

According to an embodiment, the second sealing device comprises at least one seal.

The seals of the first and/or second sealing device may be, for example, labyrinth seals, brush seals, seals having a calibrated cross section or carbon ring seals.

Preferably, the second sealing device comprises at least one block of abradable material and the seal or seals of the second sealing device are labyrinth seals which each comprise an assembly of sealing strips which cooperate with the block or blocks of abradable material. In such a case, the calibration of the pressure of the bleed air may be carried out, for example, depending on the point at which the air is bled in the seal or seals and/or by changing the number and/or the shape of the sealing strips.

Likewise, the first sealing device advantageously comprises at least one block of abradable material and the seal or seals of the first sealing device are labyrinth seals which each comprise an assembly of sealing strips which cooperate with the block or blocks of abradable material.

Advantageously, the sealing strips of the seal or seals are arranged consecutively and in parallel, preferably perpendicularly to the longitudinal axis of the turbine engine.

In an embodiment, the second sealing device comprises a single seal which is configured to allow some of the air passing therethrough to be bled. For example, a bleed air channel may be arranged between the two ends of the seal of the second sealing device in order to carry out said bleeding.

In another embodiment, the second sealing device comprises a front seal and a rear seal, the air being bled between the two seals. Therefore, the air coming from the channel for conveying compressed air passes, in a direction from the rear to the front, through the rear seal and then flows in part between the two seals to the seal of the first sealing device in order to keep it under pressure. A bleed air channel can be easily produced between the two seals, which can thus be mounted on different elements of the turboshaft engine, for example.

Advantageously, a cavity is made between the front seal and the rear seal of the second sealing device so as to form a pressurised air pocket between the two seals, in which the air is bled in order to be conveyed to the seal of the first sealing device. The front seal and the rear seal of the second sealing device may be spaced apart, for example, by a distance which is greater than 1 mm, preferably of between 2 and 10 mm.

Preferably, the rear seal of the second sealing device is configured such that the pressure of the air which is bled as it passes into the second sealing device is sufficient to keep the seal of the first sealing device under pressure and to thus prevent oil from leaking from the guide bearing. Such a calibration of the pressure of the bleed air may be carried out, for example, by changing the number and/or the shape of the sealing strips in the case of a labyrinth seal.

Advantageously, the rear seal of the second device comprises between one and three sealing strips, preferably two sealing strips.

Still preferably, the front seal of the second sealing device is configured so as to reduce the flow rate of air passing therethrough as much as possible so as to avoid disturbing the flow of air in the rear part of the movable compressor wheel onto which said joint opens (in the upstream to downstream direction). "As much as possible" means that the flow rate of the airflow which discharges from the front seal is sufficiently low to avoid a flow of air, at the rear of the movable wheel, which would be likely to significantly reduce the efficiency of compression.

Advantageously, the front seal of the second device comprises at least two sealing strips, preferably four, so as to sufficiently reduce the flow rate of the airflow passing therethrough.

Preferably, the first sealing device comprises a front seal and a rear seal. The airflow which is bled in the region of the second sealing device allows the front seal or the two seals of the first device to be kept under pressure.

According to an embodiment, the turbine engine comprises a second compression stage comprising a second movable compressor wheel of which a front portion is connected to a rear portion of the first movable compressor wheel in the region of the second sealing device by a coupling, for example a curvic coupling, in which a passage is provided, the air which is bled as the airflow passes through the second sealing device flowing through said passage before being conveyed towards the front seal of the first device in order to keep it under pressure.

Embodiments of the disclosure also relate to a method for keeping at least one seal under pressure by means of bleed air in a turbine engine, comprising:

- an air inlet duct,
- an air compression stage which comprises at least one movable compressor wheel and onto which the air inlet duct opens,
- a first sealing device, which is arranged between a front portion of the movable compressor wheel and the air inlet duct, comprising at least one seal,
- a channel for conveying the air compressed by the movable wheel,
- a second sealing device, which is arranged between a rear portion of the movable compressor wheel and the conveying channel and is configured to receive an airflow coming from the conveying channel,
- said method being remarkable in that it comprises a step of bleeding some of the air passing through the second sealing device and a step of conveying the air which is thus bled to the seal of the first sealing device so as to keep it under pressure.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed. Embodiments of the disclosure are described hereinafter in relation to an aircraft turboshaft engine, but it may of course be used more generally in a turbine engine, in particular for an aircraft, comprising any type of compressor, for example a centrifugal compressor, a dual-centrifugal compressor or a mixed compressor.

The terms "front" and "rear" refer to the position of elements which are located relative to the direction of the central axis X'X of rotation of the parts of the turboshaft engine, in particular of the compression and expansion rotors, which corresponds to the overall direction of the airflow passing through the turboshaft engine during operation. Likewise, the terms "upstream" and "downstream" are understood in relation to the direction of the airflow circulating in the turbine engine.

Figure 1:
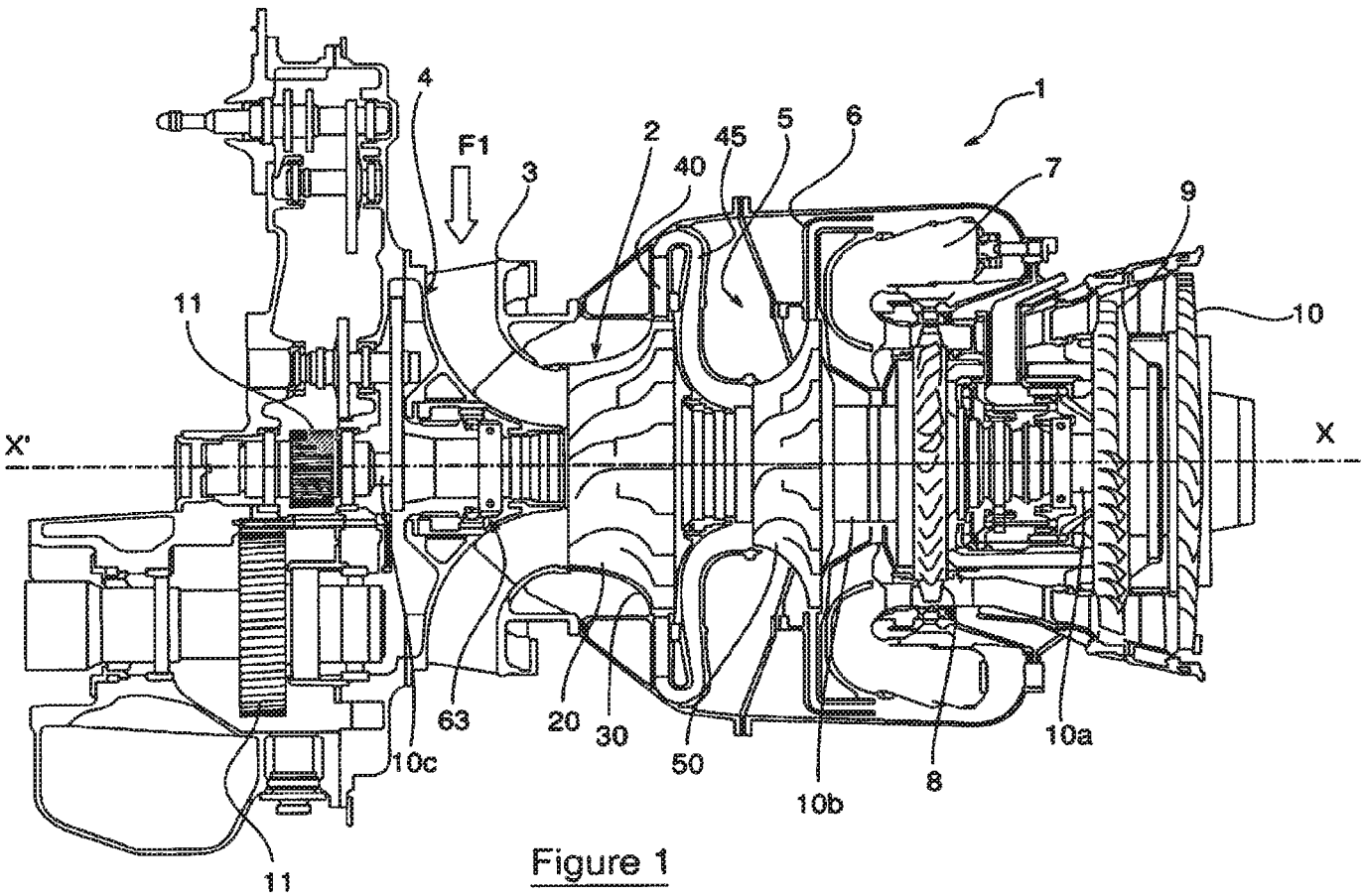
FIG. 1 is a longitudinal section through a turboshaft engine.

FIG. 1 schematically shows a helicopter turboshaft engine 1 comprising a first compression stage or compressor 2. In such a turboshaft engine, air (arrow F1) is introduced into an air inlet 3 and is carried into an air inlet duct 4 which forms a channel which opens onto the first compression stage 2. The air compressed by the first compression stage 2 is conveyed towards a second compression stage 5.

The air compressed by the second stage 5 discharges via a radial diffuser 6 and is then injected into a combustion chamber 7 in order to be mixed with fuel therein and to supply, after combustion, kinetic energy to set into rotation turbines 8, 9 and 10. The turbine 8 in turn drives the compressors 5 and 2 via the shaft 10*b*. The turbines 9 and 10 transmit power via the shaft 10*a* in order to drive via a speed reduction unit 11, for example, a helicopter rotor and/or equipment (pump, alternators, load compressor, etc.).

Each compression stage comprises a movable compressor wheel, which may be axial (axial compressor), radial (centrifugal impeller) or mixed. The turboshaft engine shown comprises two compression stages, but of course the turbine engine according to the disclosure may also comprise a single compression stage or more than two compression stages.

Figure 2:
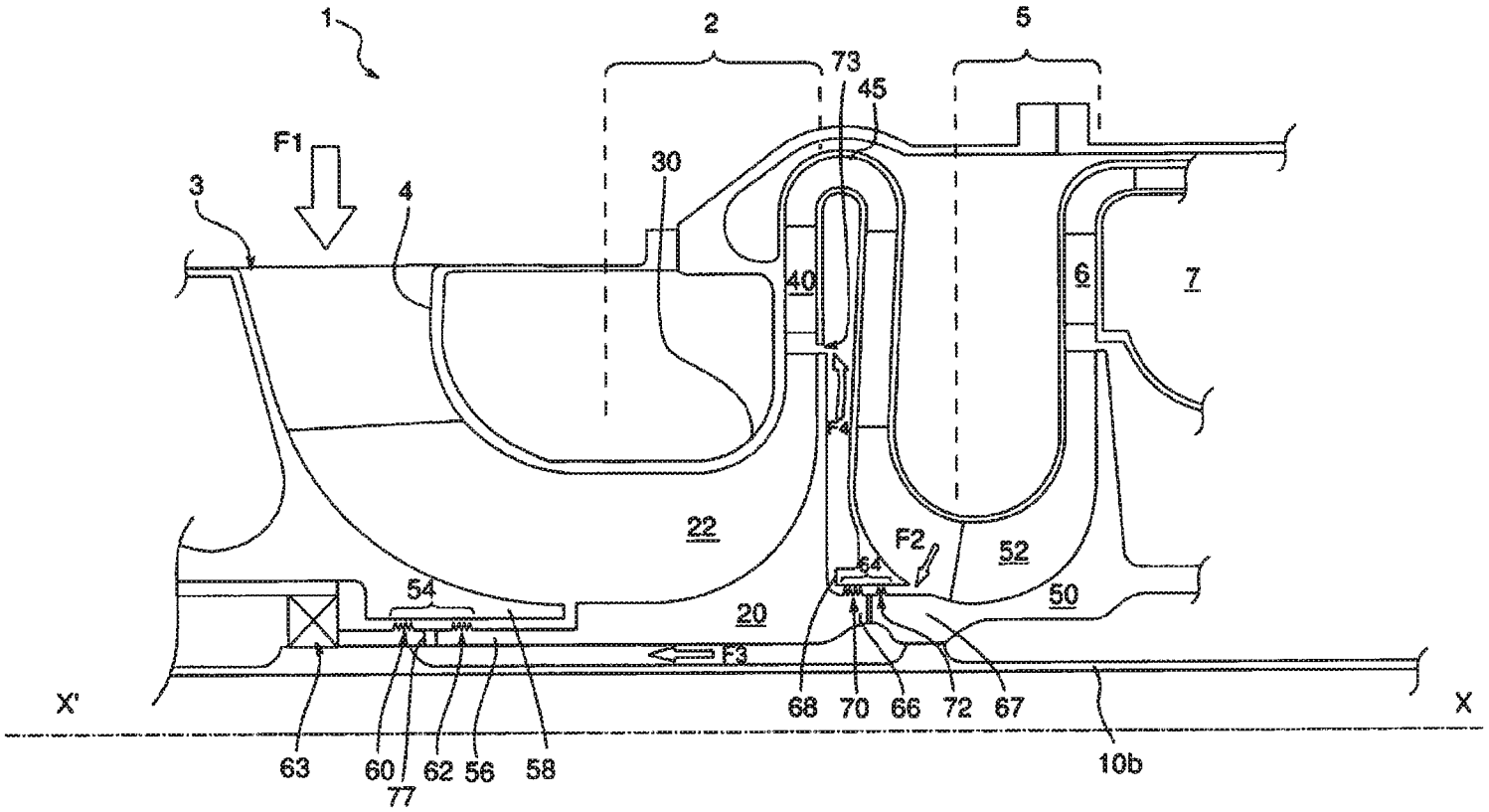
FIG. 2 is a partial sectional view of a turboshaft engine according to the disclosure.

The compressor 2 comprises a first movable wheel 20 which is intended to rotate within a casing 30 and comprises fins 22 for guiding the airflow (with reference to FIG. 2). In this example, the compressor comprises a bladed diffuser 40 which is inclined in the extension of the movable wheel 20.

An air conveying channel 45, which is coupled to the diffuser 40, extends between the first compression stage 2 and the second compression stage 5 onto which it opens and allows the air compressed by the first compression stage 2 to be conveyed to the second compression stage 5. The second compression stage 5 comprises a second movable compressor wheel 50 which opens onto the diffuser 6 and comprises fins 52 for guiding the airflow (with reference to FIG. 2).

As shown in FIG. 2, the turboshaft engine 1 comprises a first sealing device 54, which is arranged between a front portion 56 of the movable compressor wheel 20 and an axial portion 58 of the air inlet duct 4. This first sealing device 54 comprises a front seal 60 and a rear seal 62, between which an air passage 77 is made.

A bearing 63 for guiding the rotor relative to the stator is arranged in front of the first sealing device 54 and comprises lubricating oil which is kept in the bearing 63 by the pressure of the air in the region of the front seal 62 of the first sealing device 54.

The turboshaft engine 1 comprises a second sealing device 64, which is arranged between a rear portion 66 of the movable compressor wheel 20, a front portion 67 of the second movable wheel 50 and a portion 68 of the channel 45 for conveying air compressed by the movable wheel 20, all three extending substantially in a direction parallel to the axis X'X.

This second device 64 comprises a front seal 70, which is arranged between the portion 68 of the conveying channel 45 and the rear portion 66 of the first movable wheel 20, and a rear seal 72, which is arranged between the portion 68 of the conveying channel 45 and the front portion 67 of the second movable compressor wheel 50.

According to the disclosure, the second sealing device 64 is configured to allow some of the air passing therethrough to be bled, the bleed air in this case being conveyed to the front seal 60 of the first sealing device 54 so as to keep it under pressure.

In this example, the seals of the devices are labyrinth seals which each comprise an assembly of annular sealing strips which are arranged consecutively in a direction parallel to the axis X'X and cooperate in a known manner with a block of abradable material to form the seal.

Figure 3:
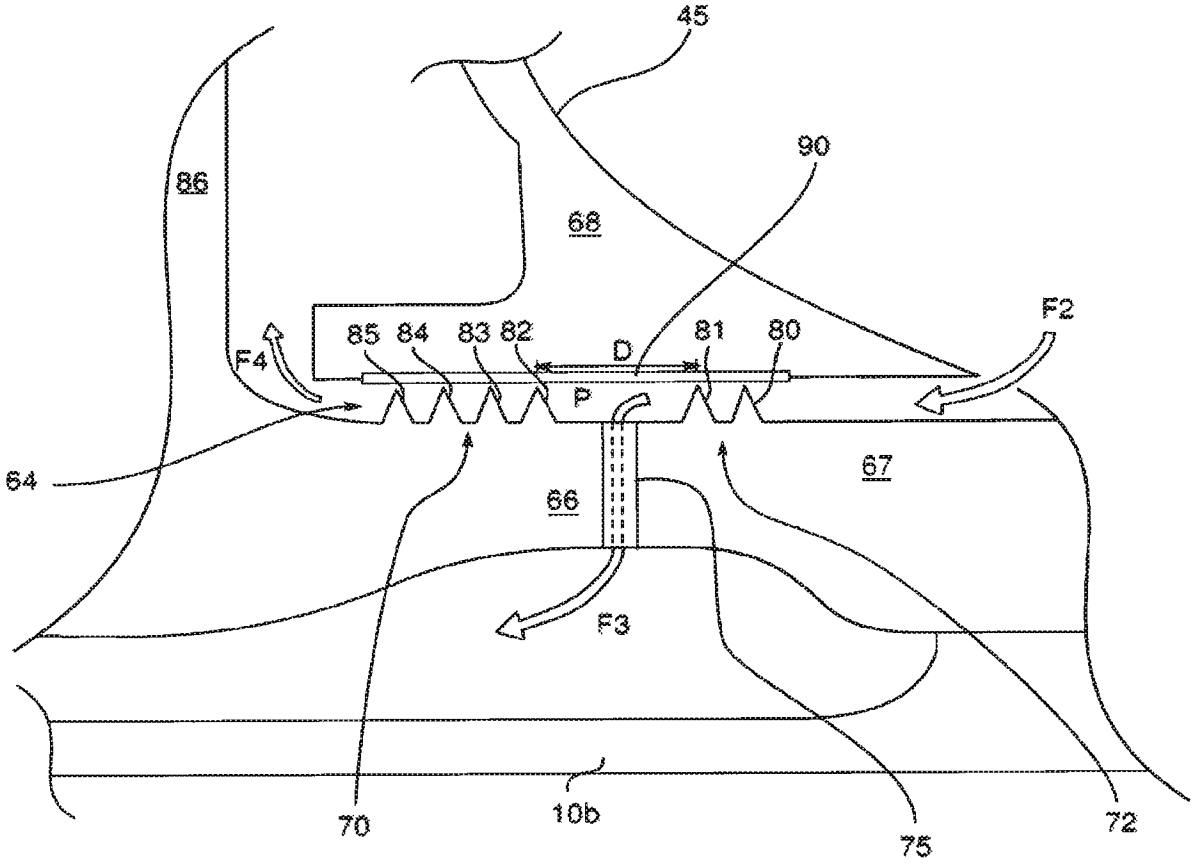
FIG. 3 is a partial sectional view of the seal of the second sealing device of the turboshaft engine in FIG. 2.

As shown in FIG. 3, the airflow F3 which keeps the front seal 60 of the first device 54 under pressure is bled between the rear seal 72 and the front seal 70 of the second device 64.

In order to obtain a flow rate of bleed air which is sufficiently high to keep the rear seal 62 of the first device 54 under pressure, the rear seal 72 of the second device 64 comprises, as shown in FIG. 3, two sealing strips 80 and 81 which cooperate with a block of abradable material 90 which is fixed to the portion 68.

The front seal 70 of the second device 64 comprises four sealing strips 82, 83, 84 and 85 which cooperate with the block of abradable material 90 and make it possible to make the flow rate of the airflow passing through the front seal 70 very low or almost zero and to thus avoid disturbances in the rear part 86 of the first movable compressor wheel 20.

During operation of the turboshaft engine 1, as shown in FIG. 2, the airflow F1 enters the air inlet duct 4, is compressed by the first movable compressor wheel 20 and is then conveyed towards the second movable compressor wheel 50. Some F2 of this airflow which is compressed by the first movable compressor wheel 20 penetrates into the second sealing device 64.

As shown in FIG. 3, the airflow F2 passes, from the rear to the front, through the rear seal 72 to a pressurised air pocket P which extends over an axial distance D between the front seal 70 and the rear seal 72.

Some F4 of the flow F2 which has passed through the rear seal 72 to the pressurised air pocket P passes through the front seal 70 to a space 86 located behind the first movable compressor wheel 20. The flow rate of the airflow F4 which has passed through the front seal 70 is relatively low or almost zero, given that the air has passed through both the rear seal 72 and then the front seal 70, which in this case is configured specifically to greatly reduce the flow rate of the flow F4. This makes it possible to greatly limit the flow rate of the airflow F4 which returns, via a passage 73, into the airflow which is compressed by the first movable wheel 20, thus improving the efficiency of the compression.

The remainder F3 of the flow F2 which has passed through the rear seal 72 to the pressurised air pocket P is bled in order to be conveyed through a passage 75 towards the front seal 60 of the first device 54 so as to keep it under pressure.

In this example, the passage 75 extends between a rear portion 66 of the first movable compressor wheel 20 and a front portion 67 of the second movable compressor wheel 50. The connection between the rear portion 66 of the first movable compressor wheel 20 and the front portion 67 of the second movable compressor wheel 50 may be produced, for example, by curvic coupling, such that the passage 75 is thus made between the teeth of the gears.

Figure 4:
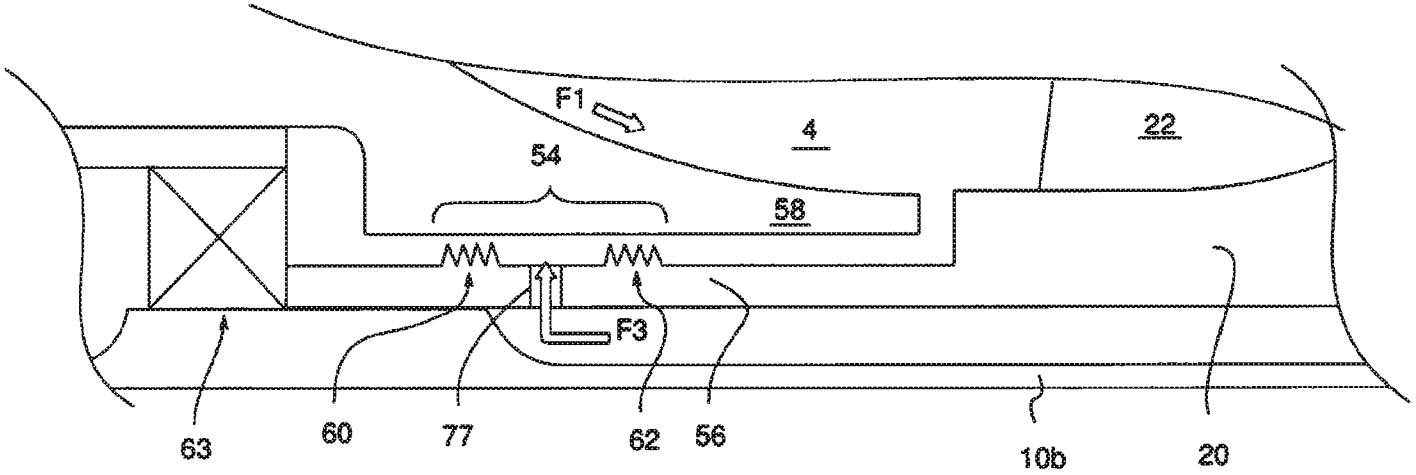
FIG. 4 is a partial sectional view of the seal of the first sealing device of the turboshaft engine in FIG. 2.

Referring to FIG. 4, once it has passed through the passage 75, the airflow F3 which has been bled between the two seals 70 and 72 of the second sealing device 64 is conveyed to a second passage 77 through which it passes in order to reach the front portion of the rear seal 62 of the first sealing device 54. The rear seal 62 is thus kept under pressure by the bleed airflow F3, so as to prevent the oil which is inside the first device from leaking through the passage 77 into the air inlet duct 4 and/or into the compression stage 2.

Embodiments of the disclosure therefore make it possible to keep the seal or seals of the first sealing device under pressure and to thus prevent oil leaks which are linked to a reduction in pressure of one of the seals of the first device, for example of the rear seal, in particular in the case of a reduction in pressure in the air inlet duct of the turbine engine.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The invention claimed is:

1. A turbine engine, comprising:

an air compression stage which comprises at least one movable compressor wheel, an air inlet duct which is coupled to said air compression stage, a first sealing device, which is arranged between a front portion of the movable compressor wheel and the air inlet duct, comprising at least one seal, a channel for conveying the air compressed by the movable wheel, a second sealing device, which is arranged between a rear portion of the movable compressor wheel and the conveying channel and is configured to receive an airflow coming from the conveying channel, wherein the second sealing device is configured to allow some of the air passing therethrough to be bled, the bleed air being conveyed to the at least one seal of the first sealing device so as to keep the at least one seal of the first sealing device under pressure, wherein the second sealing device comprises a front seal and a rear seal, the air being bled between the front seal and the rear seal of the second sealing device, wherein the rear seal of the second sealing device is configured such that the flow rate of bleed air is sufficient to keep the at least one seal of the first sealing device under pressure, and wherein the front seal of the second sealing device is configured so as to reduce the flow rate of air passing therethrough as much as possible so as to avoid disturbing the flow of air in a rear part of the movable compressor wheel onto which said front seal of the second sealing device opens.

2. The turbine engine according to claim 1, wherein the second device comprises at least one block of abradable material and a labyrinth seal which comprises an assembly of sealing strips which cooperate with the at least one block of abradable material.

3. The turbine engine according to claim 1, wherein the rear seal of the second device comprises between one and three sealing strips.

4. The turbine engine according to claim 1, wherein the front seal of the second device comprises at least two sealing strips.

5. The turbine engine according to claim 1, wherein the rear seal of the second sealing device and the front seal of the second sealing device are spaced apart by a distance which is greater than or equal to 2 mm, so as to form a pressurised air pocket in which the air can be bled in order to be conveyed to the seal of the first sealing device.

6. The turbine engine according to claim 1, said turbine engine comprising a second movable compressor wheel of which a front portion is connected to a rear portion of the first movable compressor wheel in the region of the second sealing device by a coupling, in which a passage is made, the air which is bled as the airflow passes through the second sealing device flowing through said passage before being conveyed towards the seal of the first device in order to keep the seal of the first sealing device under pressure.

7. A method for keeping at least one seal under pressure by bleeding air in a turbine engine, the turbine engine having:

an air compression stage comprising at least one movable compressor wheel, an air inlet duct coupled to said air compression stage, a first sealing device, which is arranged between a front portion of the movable compressor wheel and the air inlet duct, comprising at least one seal, a channel for conveying the air compressed by the movable wheel, a second sealing device, which is arranged between a rear portion of the movable compressor wheel and the conveying channel and is configured to receive an airflow coming from the conveying channel, wherein the second sealing device comprises a front seal and a rear seal, the method comprising:

bleeding some of the air passing through the second sealing device, the air being bled between the front seal and the rear seal of the second sealing device;

conveying the air which is thus bled to the at least one seal of the first sealing device so as to keep the at least one seal of the first sealing device under pressure; and reducing the flow rate of air passing through the front seal of the second sealing device to avoid disturbing the flow of air in a rear part of the movable compressor wheel onto which said front seal of the second sealing device opens.

8. The turbine engine according to claim 3, wherein the rear seal of the second device comprises two sealing strips.

9. The turbine engine according to claim 4, wherein the front seal of the second device comprises four sealing strips.

10. The turbine engine according to claim 6, wherein said the front portion of the second movable compressor wheel is connected to the rear portion of the first movable compressor wheel in the region of the second sealing device by a curvic coupling.

* * * * *